US009273832B2

(12) United States Patent
Van Gompel et al.

(10) Patent No.: US 9,273,832 B2
(45) Date of Patent: Mar. 1, 2016

(54) FIXATION DEVICE AND AN ASSEMBLY STRUCTURE

(75) Inventors: Waltherus Emericus Johannes Van Gompel, Eersel (NL); Niels De Koning, Nijmegen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 90 days.

(21) Appl. No.: 14/126,084

(22) PCT Filed: Jun. 13, 2012

(86) PCT No.: PCT/IB2012/052979

§ 371 (c)(1),
(2), (4) Date: Dec. 13, 2013

(87) PCT Pub. No.: WO2012/172493

PCT Pub. Date: Dec. 20, 2012

(65) Prior Publication Data

US 2014/0119031 A1 May 1, 2014

(30) Foreign Application Priority Data

Jun. 17, 2011 (EP) ..... 11170300

(51) Int. Cl.
*F21K 99/00* (2010.01)
*F21V 19/00* (2006.01)
*F21Y 101/02* (2006.01)

(52) U.S. Cl.
CPC ..... *F21K 9/30* (2013.01); *F21V 19/0055* (2013.01); *F21Y 2101/02* (2013.01)

(58) Field of Classification Search
CPC .... F21K 9/30; F21V 19/0055; F21Y 2101/02
See application file for complete search history.

(56) References Cited

U.S. PATENT DOCUMENTS

| | | | | |
|---|---|---|---|---|
| 6,641,284 | B2 * | 11/2003 | Stopa et al. | 362/240 |
| 7,938,558 | B2 * | 5/2011 | Wilcox et al. | 362/236 |
| 8,101,434 | B2 * | 1/2012 | Guillien et al. | 438/15 |
| 8,405,288 | B2 | 3/2013 | Tsai | |
| 2005/0231949 | A1 * | 10/2005 | Kim et al. | 362/249 |
| 2007/0041220 | A1 * | 2/2007 | Lynch | 362/646 |
| 2007/0268707 | A1 | 11/2007 | Smester | |
| 2008/0008427 | A1 | 1/2008 | Takeda et al. | |
| 2010/0014287 | A1 | 1/2010 | Chiang et al. | |
| 2010/0046232 | A1 | 2/2010 | Matsui et al. | |
| 2010/0110679 | A1 * | 5/2010 | Teng et al. | 362/235 |

FOREIGN PATENT DOCUMENTS

| | | | |
|---|---|---|---|
| DE | 202010009679 | U1 | 10/2010 |
| EP | 1758179 | A1 | 2/2007 |
| WO | 2007128070 | A1 | 11/2007 |

* cited by examiner

*Primary Examiner* — Elmito Breval

(57) ABSTRACT

There is provided a fixation device (100) and an assembly structure 10 comprising light emitting diode module, LED module, (200) and at least one fixation device (100) for in a mounted position fixating the LED module to a mounting surface (300). The fixation device comprises a main body (103), a first fixation means (102) for securing LED module to the mounting surface, a second fixation means (106, 506) for securing the fixation device to the LED module and at least one resilient portion (107, 108) arranged to extend from the main body and to, in a mounted position, at least partly bear against a predetermined bearing surface (201, 202) of the LED module such that a controlled force which is independent of the first fixation means is applied the bearing surface of the LED module by means of the resilient portion.

8 Claims, 5 Drawing Sheets

FIXATION DEVICE AND AN ASSEMBLY STRUCTURE

TECHNICAL FIELD

The present invention relates to the field of light emitting diode modules, LED modules, and more particularly to a fixation device for mounting a LED module onto a mounting surface and a corresponding assembly structure comprising the LED module and such a fixation device.

BACKGROUND OF THE INVENTION

An increasing number of LED driven luminaires are on the market today. Many of these systems are equipped with LED modules, which typically comprise a plurality of LEDs which are arranged on a base plate. In many applications the LED modules are fixed against a metal mounting surface of the luminaire. The performance and lifetime of these LED modules depend, for an important piece, on the interfaces between LED modules and luminaires because the luminaire casing will function as a heat sink.

A very common mechanical assembly structure for these LED modules utilizes screw connections which are screwed directly into the mounting surface via the housing of the LED-module, which is schematically illustrated in FIGS. 1*a* and 1*b*. In FIG. 1*a* and 1*b* a LED module 1 is illustrated in a mounted position on a mounting surface 2, i.e. the luminaire casing. The LED module 1 comprises a base plate 4, e.g. a printed card board, PCB, onto which a plurality of LEDs 3 are arranged. A plastic housing 5 covers the LED module 1. The LED module 1 further comprises a power connector (not shown). Here six screws 8 fixate the LED module 1 to the mounting surface 2 via the LED module housing 5. Different possible disadvantages and risks are connected with these kinds of screw connections. Firstly, the screws 8 have to be mounted with a defined torque because of the risk of stress cracking of the plastic parts in the housing 5. These torques differ from case to case and depend on many aspects like the type of screws, the hole dimensions for receiving screw holes in the mounting surface 2 of the luminaire when thread-forming screws are being used, the type of material of the mounting surface 2 etc. Another risk is that screws come loose in vibrating applications, e.g. street lighting applications, because of creepage effects in the plastic parts of the housing 5 and/or the low required initial screw torque. In this case LED modules will come loose, get overheated and break down. To overcome these risks customers have to take measures like using locking agent to lock the screws.

Further, a good thermal connection between the LED module 1 and the mounting surface 2 of the luminaire requires a well defined attachment between those two. Typically, a thermal interface material 7 is applied between the base plate 4 and the mounting surface 2 to avoid any air-gaps between the mounting surface and the LED module in order to get a lower and better defined thermal resistance. The performance of some thermal interface materials (e.g. thermal gap-pad materials) is very sensitive to how a LED module 1 is fixed at the mounting surface 2 in terms of the value of the pressing force F from the screws and the equability of the distribution of different pressing forces $F_R$ at the thermal interface, as illustrated in FIG. 1*b*. By using screws, very high peak forces are easily introduced. This can result in an unwanted bended bottom surface, as illustrated with arrows B in FIG. 1*a*, and also unwanted air gaps 9 in the critical thermal interface. This will have a negative impact on the thermal reliability and therefore the lifetime of the LED module 1.

To continue with reference to the prior art assembly of FIG. 1, by heating up (LED module 1 is switched on) and cooling down (LED module 1 is switched off) the different parts of the LED module 1 will move compared to each other because of their different thermal expansion behavior. By using screws 8 which apply locally high peak forces to the LED module 1, as described above, the different materials of the base plate 4 and the housing 5 cannot or can only move very little compared to each other. This can result in exceeding the maximum allowed stress level in the plastic housing 5 or that unwanted bending effects occur in these parts, as illustrated with the arrows indicated with B in FIG. 1*a*.

LED modules are being sold with a long lifetime guarantee so they must withstand many thermal cycles meaning that the risk of material failures over time could be big especially in outdoor applications.

SUMMARY OF THE INVENTION

In view of the above, an object of the invention is to at least alleviate the problems discussed above. In particular, an object is to provide a fixation device and an assembly structure that provide an improved way of mounting the LED modules into different lighting applications, and which do not require accurate torque controlled screw drivers and that increase the reliability and whole product life time of the LED modules in their mounted position.

According to a first aspect of the inventive concept, there is provided a fixation device comprising a main body, a first fixation means for securing the LED module to a mounting surface, a second fixation means for securing the fixation device to the LED module and at least one resilient portion arranged to extend from the main body and to, in a mounted position, at least partly bear against a predetermined bearing surface of the LED module such that a controlled force which is independent of the first fixation means is applied to the bearing surface of the LED module by means of the resilient portion.

In this way a fixation device for mounting a LED module to a mounting surface is provided, which utilizes a first fixation means to fixate the LED module to the mounting surface, and which fixation device simultaneously, by means of the at least one resilient portion, provides a defined and reproduce-able force against the predetermined bearing surface of the LED module. By providing a predetermined controlled spring force of the resilient portion, an improved and defined thermal interface between the backside of the LED module and the mounting surface is advantageously achieved. By applying a spring-defined pressing force at defined positions in critical areas of the LED module, the gap between the LED module and the mounting surface will be minimized and also by pressing a thermal interface material which may be applied between the LED module and the mounting surface, any air gaps will be pushed aside. This in turn improves the thermal performance of the LED module in its application. The second fixation means provides for a connection between the fixation device and the LED module which is advantageous, for example, during transport and handling by a user, for example during initial installation and during maintenance activities, in which LED modules may be exchanged, it is prevented that the fixation device gets lost.

With the present inventive concept the first fixation means, which may be for instance a screw arranged in a hole of the fixation device main body and extending to a receiving screw hole in the mounting surface, e.g. a lamp fixture, can be tightened without special precautions or torques because the tightening will not have effect on the mentioned critical thermal interface. The first fixation means may be realized with other fastening means, like a rivet, a snap connection etc.

Further, because of the defined and relative low force applied to the lighting module by means of the at least one resilient portion, as compared to the prior art solution of using screws to fixate and apply a pressure force directly on the lighting module as described above, movement of the LED module caused by different thermal expansion of different materials used in the LED module is allowed under the resilient portion, without the risk of e.g. damaging the plastic housing over time. The thermally induced stresses in materials introduced by mounting of the LED modules and caused by differences in thermal expansion coefficients are thereby considerably reduced.

The present inventive concept further allows a narrow and low design of LED modules as compared to LED modules with screws arranged in the middle zone.

According to an embodiment of the fixation device, the fixation device comprises a vertical portion extending from the main body in a substantial perpendicular direction from which vertical portion the at least one resilient portion extends. The vertical portion of the fixation device advantageously stiffens the fixation device in the cross direction to prevent unwanted bending effects caused by the pressing force of the resilient portion. The vertical portion extends substantially perpendicular from a main plane of the main body. The vertical portion is thus located in between the main body and the at least one resilient portion.

Optionally, the first fixation means is arranged such that the fixation device is able to release the LED module without a complete dismounting of the first fixation means. Advantageously, the fixation device does not have to be completely dismounted in case of service of the LED module. As an example, when utilizing a screw as first fixation means, the screw can be loosened just enough to release the force on the bearing surface on the LED module, such that the LED module may be exchanged or attended to by the service technician. Since the screw does not have to be dismounted completely, it cannot get lost during service or even worse fall out, which is very dangerous when attending to e.g. street lighting luminaires, in which case people passing below the street lighting luminaire may get hit.

According to an embodiment of the fixation device, the second fixation means comprises two fixation means arranged at opposite sides of the main body. This provides for a secure connection between the fixation device and the LED module.

Optionally, the resilient portion comprises a protruding portion arranged on a side of the resilient portion which faces the LED module.

The protruding portions, whether being arranged on the resilient portion or the LED module upper surface, which is described below, advantageously define a position where the pressing force from the at least one resilient portion is applied, and is thus preferably arranged such that the bearing surface is positioned in the most critical area of the LED module, e.g. in the middle of the LED area.

According to an embodiment of the fixation device, the first fixation means is symmetrically arranged on the main body. By arranging the first fixation means in a symmetrically positioned way, the most stable construction without unwanted tilting effects is achieved. A stable position of the main body is important to allow independent pressing forces by means of the resilient portions at the corresponding bearing surfaces. Further, symmetrical positioning of the first fixation means is simpler for a user, e.g. it is very easy to determine the drill pattern for mounting the LED module in a luminaire when matching the symmetrical centre line of the LED module, and, furthermore, there is no difference between the possible left and right positions of the LED module in the luminaire.

According to an embodiment of the fixation device, the main body has an orifice arranged to receive the first fixation means. Thereby, the fixation means, which may be e.g. a screw or the like, is advantageously positioned in the orifice, i.e. a hole adapted to receive the screw, and screwed into the mounting surface (via an opening in the LED module). The force applied by the screw head on the main body is symmetrically distributed in the area surrounding the screw hole.

According to an embodiment of the fixation device, the first fixation means is arranged at an end portion of the LED module. This arrangement allows the use of only one fixation means, like a screw. Further, as the fixation means is arranged at an end portion of the LED module, the maximum space for additional optical components, like a reflector at the LED area is increased. Although having a single fixation point, at the first fixation means, the fixation device may be arranged with for instance two resilient portions, which provide well defined and equal forces at a respective bearing surface of the LED module.

According to an embodiment of the fixation device, the fixation device is a metal sheet clip, which is advantageous since using metal, e.g. spring steel, for a fixation device according to the present inventive concept provides a very reliable spring. In contrast to many other materials, e.g. plastics, a metal sheet clip does not have relaxation or creepage effects over its life time, such that the initial performance of the fixation device will maintain. Further, metal allows design of the spring with a very limited form factor. Thin and narrow designs are possible because of the mechanical properties of (spring-) steel in contrast to many other materials, like plastics. Form freedom by sheet metal stamping and forming processes allows applying defined pressing forces at the most optimal positions.

According to an embodiment of the fixation device, the second fixation means is a snap connection or any other similar connection. In this embodiment the second fixation means is typically only a temporary connection, such as a snap connection, which therefore lowers the mechanical requirements on the fixation means. The main function in this embodiment is to securely connect the fixation device to the LED module for example during transport and handling by a user (during initial installation and during maintenance activities by exchanging LED modules). When the LED module has been mounted in an application, e.g. a luminaire, the functionality of the snap connections is taken over by the first fixation means completely.

Optionally the resilient portion is a wire spring or the like.

According to a second aspect of the present inventive concept there is provided an assembly structure comprising a light emitting diode module, LED module, and at least one fixation device according to the present inventive concept for in a mounted position fixating the LED module to a mounting surface, which is advantageous in a similar manner as described above for the fixation device.

Optionally the bearing surface is arranged on a protruding portion on the upper surface of the LED module.

According to an embodiment of the assembly structure, a housing is provided which is arranged to receive a base plate of the LED module and wherein the fixation device in a mounted position is arranged on top of the housing thereby fixating the housing and the LED module to the mounting surface. Advantageously the fixation device in this embodiment fixates both the housing and the LED module to the mounting surface. In a further embodiment the housing extends further than the base plate of the LED module thus forming an extending portion in which an orifice is arranged for receiving the fixation means arranged for fixating the LED module together with the housing to the mounting surface.

According to an embodiment the assembly structure comprises a plurality of fixation devices distributed over the LED module wherein each fixation device comprises a vertical portion extending from the main body in a substantial perpendicular direction and from which the at least one resilient portion extends.

According to an embodiment of the assembly structure, the LED module comprises at least one first positioning means arranged to engage with a corresponding second positioning means arranged on the mounting surface. Thereby the positioning of the LED module is simplified, and in the case of arranging the fixation device in an end portion of the LED module, a positioning means arranged e.g. on the opposite end portion of the LED module improves the positioning accuracy of the mounting the LED module. Thereby, the user may mount the LED module in a simple and intuitive manner. Further, sense and simplicity of the user is provided, since this arrangement allows tilting of the LED module at a connector end thereof, to remove the LED module while the first fixation means does not have to be completely dismounted in case of service on location.

According to an embodiment of the assembly structure, the at least one resilient portion is arranged such that the predetermined bearing surface is positioned at a high power density area of the LED module. The position of the predetermined bearing surface is advantageously selected at a position where the thermal attachment of the LED module to the mounting surface is the most critical, i.e. typically in the middle zone on the LED module. The middle zone is the most critical because the LEDs are typically densely packed close to each other on a PCB, and hence it is difficult to spread their heat in the plane direction of the metal core PCB because of the adjacent LEDs, which are also heating up the PCB. Thus, an undisturbed heat-transport in the perpendicular direction becomes very important, meaning the shortest way through the PCB, via the thermal interface to the mounting surface. When providing a pressing force by means of the resilient portions at the critical position, the thermal contact at the thermal interface is improved, such that the heat-transport in the perpendicular direction to the mounting surface is improved.

Other objectives, features and advantages will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1A:
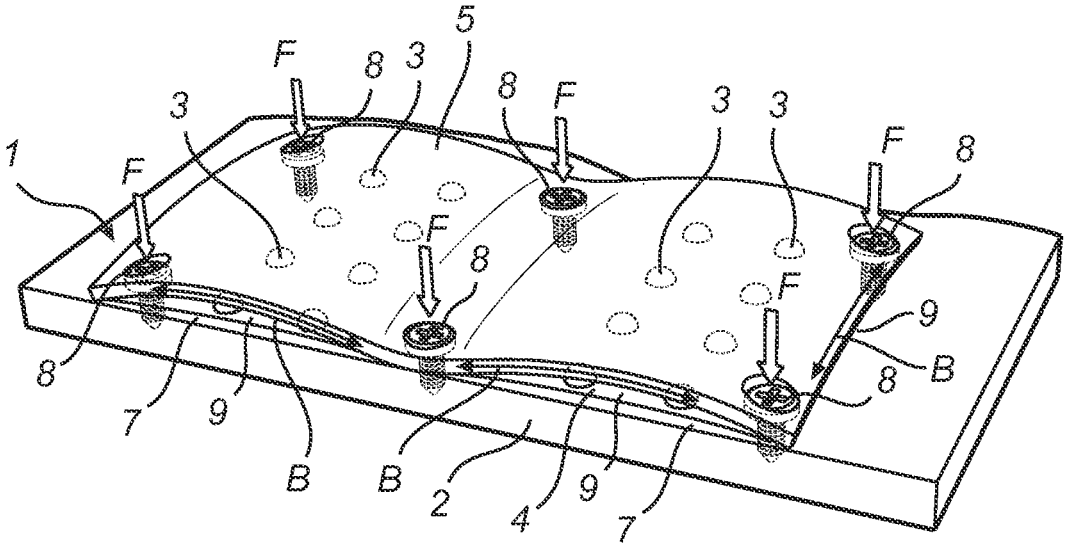
FIGS. 1*a*-1*b* are schematic perspective upper side views of a prior art assembly structure.
Figure 1B:
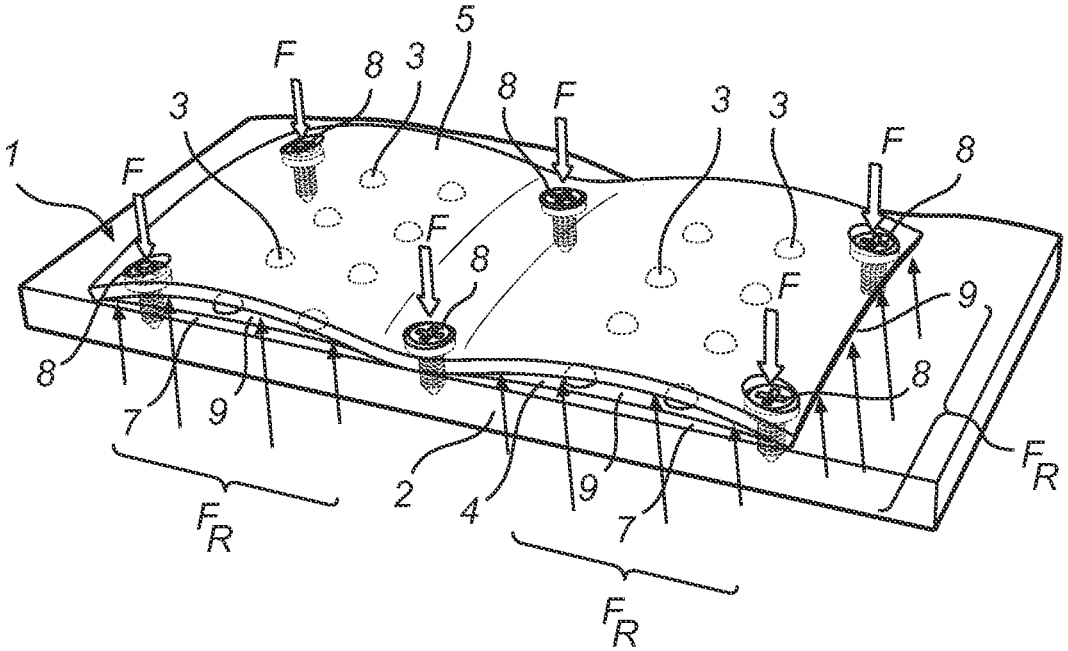
Figure 2A:
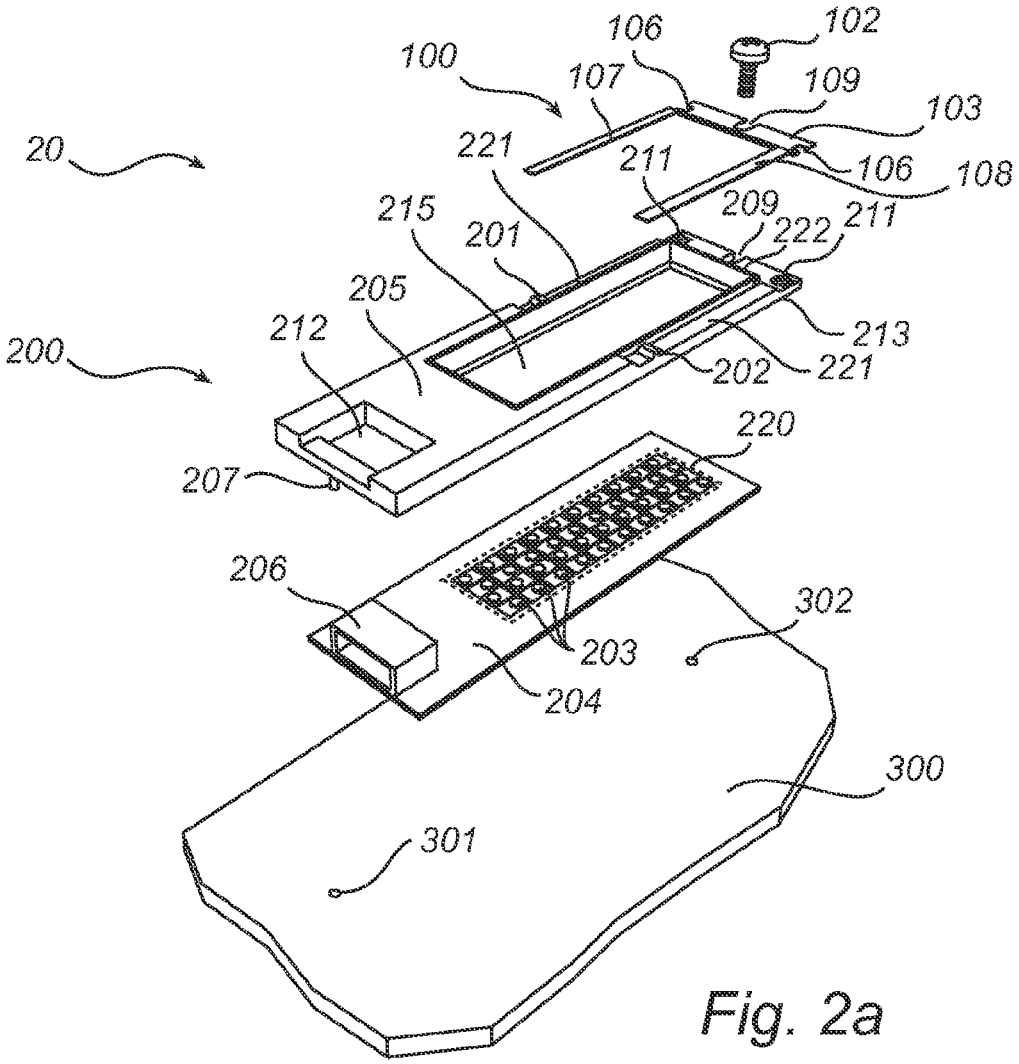
FIG. 2*a* is an exploded perspective view schematically illustrating an assembly structure according to an embodiment of the invention.

FIG. 2*a* is a perspective exploded view of an embodiment of an assembly structure 20 according to the present inventive concept. The assembly structure 20 comprises a light emitting diode (LED) module 200, and a fixation device 100 according to the present inventive concept arranged for mounting the LED module 200 to a mounting surface 300, e.g. a luminaire casing. The LED module 200 comprises a base plate 204, a PCB, onto which light sources 203, in the form of LEDs or LED packages, are mounted and electrically wired (not shown). The LEDs form a LED area 220, which corresponds to the light emitting surface of the LED module. A connector 206 for electrically powering and controlling the LED module 200 is arranged on a first end portion of, and on an upper side of, the base plate 204. Further, a housing 205 is arranged on top of the base plate 204. The housing 205 is a plastic housing arranged to cover the base plate 204 by encompassing the upper side and optionally sides thereof. The housing 205 in this embodiment further comprises a light output area 215, i.e. an opening or surface, adapted to the LED area 220 for allowing the light from the LED area 220 to exit the LED module 200. At a first end portion of the housing 205 and corresponding to the placement of the connector 206 on the base plate 204, the housing 205 is provided with a connector opening 212 for allowing the connector 206 to protrude the housing 205 when in a mounted position. The connector opening 212 and the connector 206 together further provide a positioning feature for allowing correct placement of the housing 205 onto the base plate 204. Further, a positioning portion 207 protruding downwards from the housing for positioning of the LED module 200 onto the mounting surface 300 is arranged at the first end portion of the housing 205. Optionally, the positioning feature is arranged on the base plate. The positioning portion 207 is corresponding to a positioning opening 301 arranged on the mounting surface 300. The positioning portion and corresponding positioning opening may be arranged the other way around, i.e. the receiving portion may be arranged on the LED module, while the protruding portion is arranged on the mounting surface. Alternatively the positioning feature may be excluded from the assembly structure.

Furthermore, the housing 205 is arranged to receive the base plate 204, and at a second opposite end portion of the housing 205 a step 222 is formed where the base plate 204 ends. However, here the housing 205 extends further than the length of the base plate 204, forming an extending portion 213 continuing the housing at the step 222 of the housing 205. The step 222 is arranged perpendicular to the extension of the housing 205. In the extending portion 213 an opening 209 (orifice) is arranged for receiving a first fixation means 102 arranged for fixating the LED module 200 to the mounting surface 300. In this exemplifying embodiment, the first fixation means 102 is a screw which is arranged to engage with a corresponding mounting hole 302 in the mounting surface 300. However, other fixation means are applicable, like e.g. a rivet, a bolt etc.

Figure 2B:
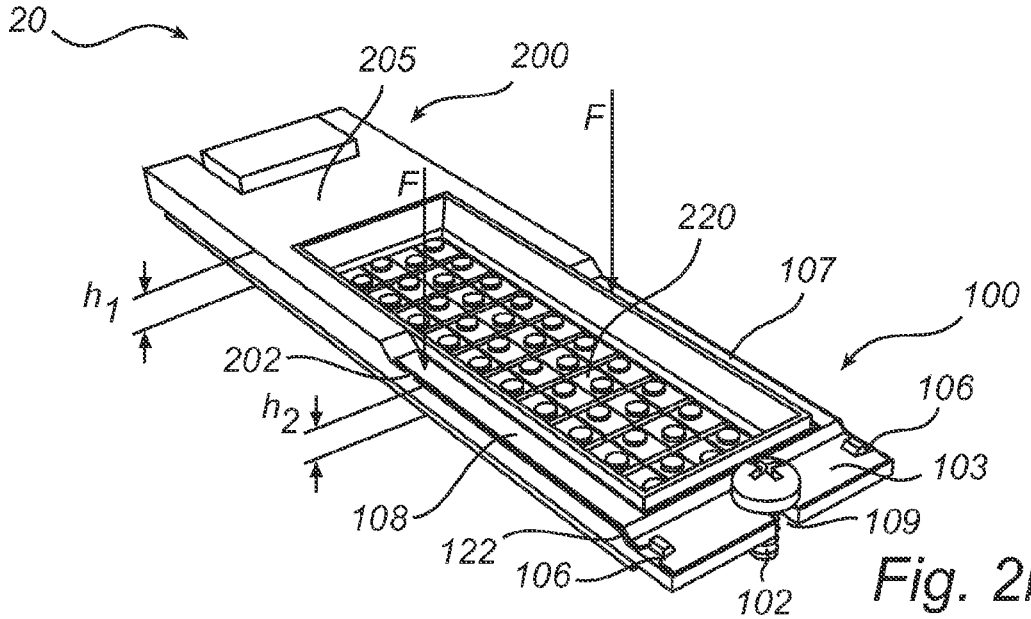
FIG. 2*b* is a perspective upper side view of the assembly structure of FIG. 2*a*.

The housing 205 is arranged to have a first height $h_1$ along the extension of the housing in a first half thereof, and arranged to have a second reduced height $h_2$ in the opposite second half of the housing, see FIG. 2*b*. Referring again to FIG. 2*a*, two protrusions 201 and 202 are arranged at an upper surface 221 of the second half of the housing 5, which has the reduced height $h_2$, and at opposite sides of the LED area 220, substantially at positions corresponding to half the total length of the LED area 220.

The assembly structure 20 further comprises a fixation device 100, which in a mounted position is arranged on top of the housing 205, see FIG. 2*b*. The fixation device 100 is here a sheet metal clip with a spring function. The fixation device 100 comprises a main body 103 arranged to fit to the extending portion 213 and the step 222 of the housing 205. The main body 103 comprises second fixation means 106, which here are snap connections 106 arranged on opposite sides of the main body 103 and which are arranged to be received in corresponding receiving connections 211 arranged in the extending portion 213 of the housing 205. The second fixation means 106 are arranged for, at least temporarily, securing the fixation device 100 to the LED module 200, e.g. during mounting, during transport of the fixation device 100 etc. Further, the opening 109 (orifice) of the main body 103, positioned corresponding to the opening 209 of the extending portion 213, is arranged to receive the first fixation means 102, i.e. here the screw, such that, when the screw is tightened with respect to the receiving screw hole 302 in the mounting surface 300, the main portion 103 is pressed against the extending portion 213 of the LED module 200, thereby fixating the LED module 200, which simultaneously has the positioning portion 207 placed in the corresponding positioning hole 301 of the mounting surface 300, against the mounting surface 300.

Furthermore, two separated resilient portions 107 and 108, arranged on separate opposite sides of the LED area 220, form the spring function of the fixation device 100. Each of the resilient portions extends from an edge 122 of the main portion 103, which is arranged such that it in a mounted position engages with the step 222 of the housing 205, and over the surface 221 of the second half of the housing 205 engages with a respective one of the protruding portions, 201 or 202. Thereby, a respective controlled pressing force, governed by the respective spring constant of the resilient portions, 107 and 108, is applied to the respective bearing surface of the resilient portions 107,108 and the protruding portions 201, 202.

Figure 2C:
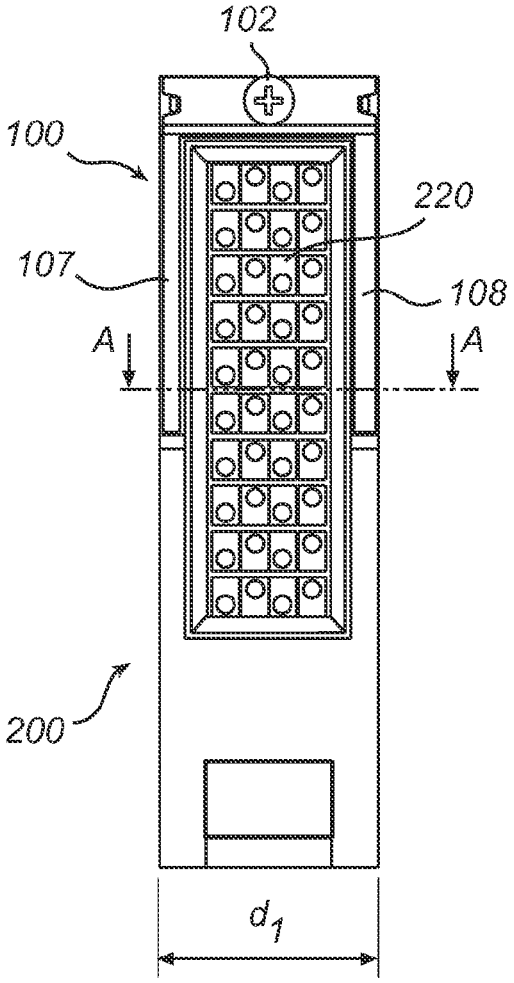
FIG. 2*c* is an upper and a cross sectional side view of the assembly structure.
Figure 2C:
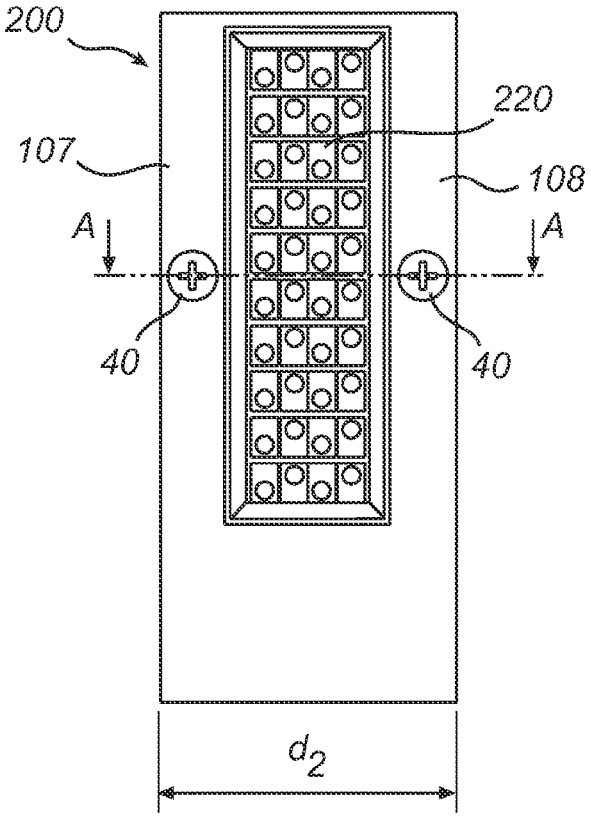
Figure 2C:
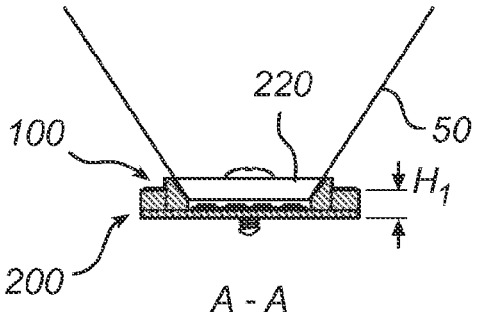
Figure 2D:
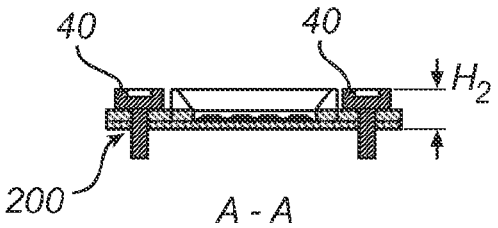
FIG. 2*d* is an upper and a cross sectional side view of an exemplifying prior art assembly structure.

FIG. 2*c* and FIG. 2*d* illustrate how the present inventive concept is advantageous when it comes to allowing narrow and low design of LED modules as compared to LED modules with screws arranged in the middle zone. FIG. 2*c*, illustrates an upper view and a cross-sectional side view of the assembly structure 20 as described above, while FIG. 2*d* illustrates an upper view and a cross-sectional side view of a prior art assembly structure utilizing screws 40 arranged on opposite sides and in the middle zone of the LED area 220 of the LED module 200. With reference now to FIG. 2*d*, when fixating a LED module 200 to a mounting surface utilizing a pair of screws 40, which screws have a typical screw head diameter of e.g. 6 mm, more than 12 mm of the LED module area outside of the LED area 220 will be occupied by the screw heads, while with the present inventive concept, as illustrated in FIG. 2*c*, the totally occupied area may be selected to be about 2-3 mm.

The reduced height dimensions of this design is further an advantage when additional and for many applications required optical components like reflectors, lenses or similar are used in luminaires for shaping the light outputted from the LED module. With the present inventive concept, the resilient portions may be of a height that is much less than the height of a typical screw head, which allows a much smaller design, total height $H_1$, of the assembly structure, as compared to the prior art assembly structure, see cross-sectional side views of FIGS. 2*c* and 2*d* where the present inventive concept allows for a reduced total height $H_1$ of the assembly structure, than the total height $H_2$ according to the prior art solution. The lower design in turn allows the positioning of these additional optical components close to the LED area. This is illustrated by the positioning of a reflector 50 close to the LED area 220 of the LED module 200 as shown in FIG. 2*c*.

A further advantage of this embodiment is that the first fixation means 102 is arranged such that the fixation device 100 is able to release the LED module 200 without a complete dismounting of the first fixation means 102 from the mounting surface 300. Thus, the fixation device 100 does not have to be completely dismounted in case of service of the LED module 200. As an example, when utilizing a screw as first fixation means 102, the screw can be loosened just enough to release the force on the bearing surface of the LED module 200, such that the LED module 200 may be exchanged or attended to by the service technician by sliding or pulling the LED module 200 from beneath the resilient portions 107 and 108. Since the screw does not have to be dismounted completely, it cannot get lost during service or, even worse, fall out, which is very disadvantageous when servicing for example street lighting luminaires.

Figure 3A:
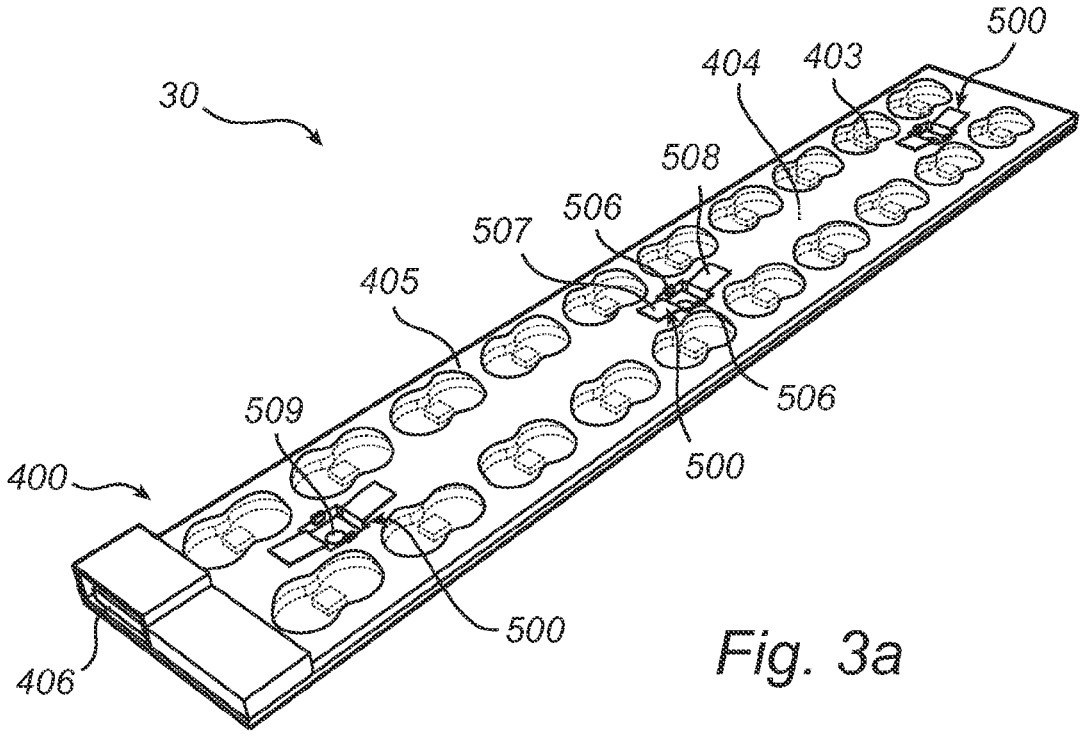
FIG. 3*a* is a perspective upper side view schematically illustrating an assembly structure according to an embodiment of the invention.

In accordance with an embodiment of a assembly structure 30 of the present inventive concept, which is described with reference to FIGS. 3*a* and 3*b*, the assembly structure 30 comprises a LED module 400 with a similar structure as the LED module 200 described above with reference to FIG. 2, in that it comprises a base plate 404 (e.g. a PCB), LEDs 403 arranged on the base plate 404, and a connector 406 for connecting power and optionally control signals to the LEDs 403. A housing 405, in this example a lens plate made in Poly(methyl methacrylate), PMMA, is arranged on top of the base plate 404. In this embodiment a plurality, or more specifically three, fixation devices 500 are distributed over the LED module 400. Each fixation device 500 comprises second fixation means 506, which are arranged to fixate the fixation device to the housing 405. The second fixation means are in this example two snap connections arranged on each fixation device 500, and which are adapted to be received in corresponding openings in the housing 405. However, any applicable fixation means may be used.

Figure 3B:
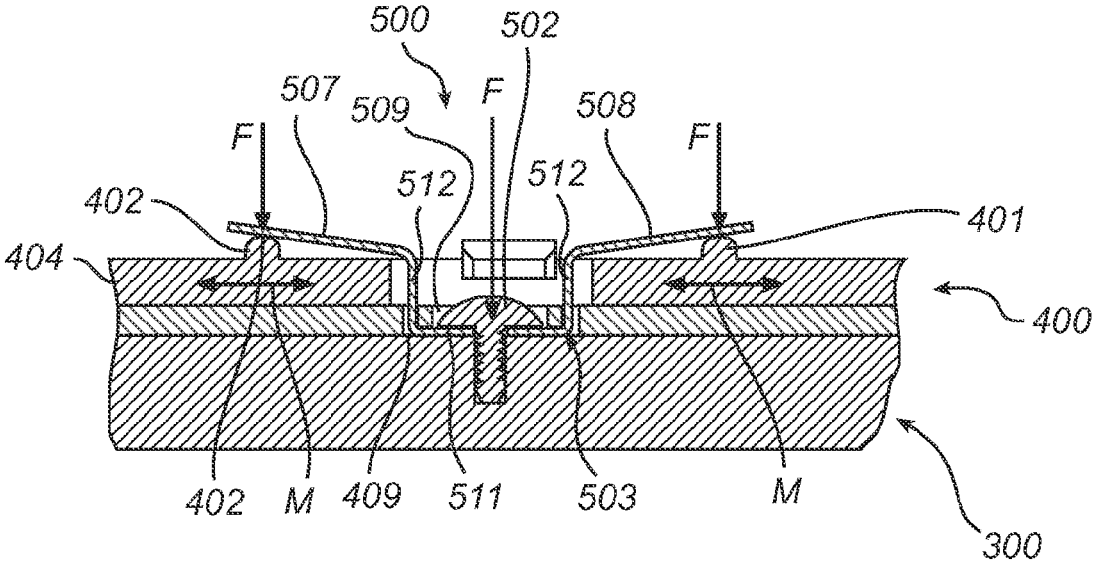
FIG. 3*b* is a schematic cross sectional view of the assembly structure of FIG. 3*a;*

With reference now to FIG. 3*b*, which is a cross-sectional close up view of a section of the assembly structure 30 when mounted on a mounting surface 300, the fixation device 500 comprises a main body 503, which comprises a flat bottom portion 511 arranged for engaging with the mounting surface 300, which bottom portion 511 is arranged with first fixation means, here implemented as an opening 509 and a screw 502 for fixating the bottom portion 511 against the mounting surface 300. Further, two vertical portions 512 are arranged on opposite sides of the bottom portion 511 and extend a substantially perpendicular direction from a main plane of the bottom portion 511. From each vertical portion 512 a respective resilient portion, 507 and 508, extends respectively. In a preferred embodiment the fixation device 500 is a metal sheet clip which is typically formed by being stamped out from a metal sheet, and which is subsequently flanged into the desired shape. The fixation devices 500 are each positioned in a respective opening 409 of the LED module 400, which opening 409 extends through both the housing 405 and the base plate 404. When fixated to the mounting surface 300 by means of the screw 502, the resilient portions 507 and 508 bear against protruding portions 401 and 402 arranged on the upper surface of the housing 405 of the LED module 400 and thereby provide a respective pressing force onto the LED module 400 such that it is secured against the mounting surface 300. The housing 405 may be mounted to the base plate 404 e.g. by means of positioning pins with friction ribs which are received in corresponding receiving openings in the base plate 404 (not shown).

Figure 4:
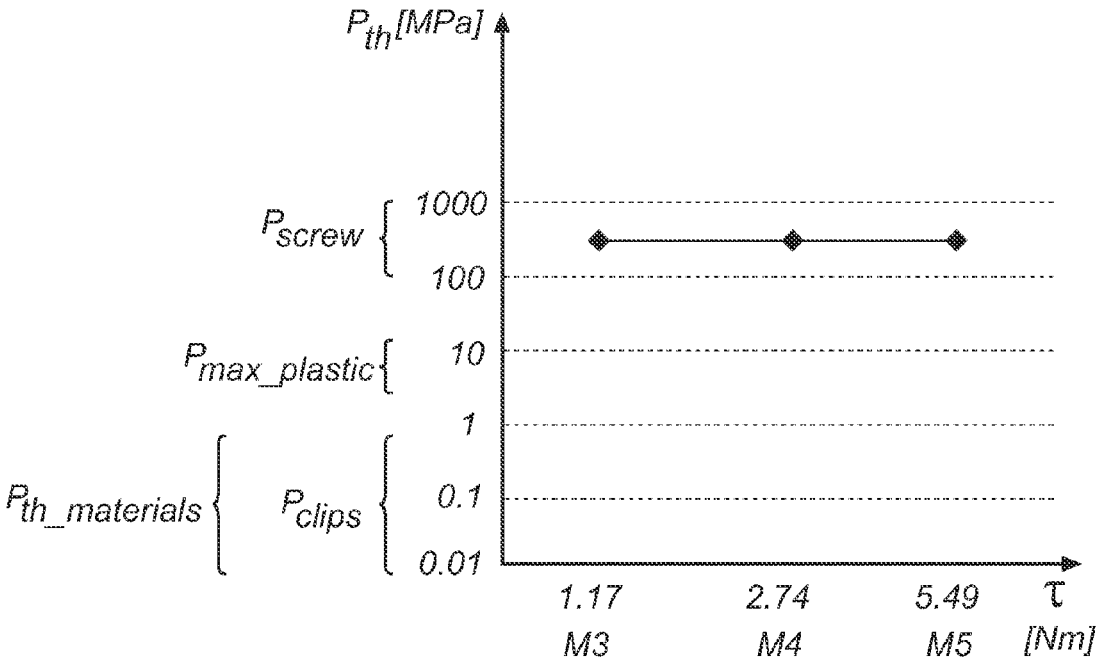
FIG. 4 is a diagram schematically illustrating different stress levels for a LED module, in which a prior art assembly structure and an assembly structure according to the present inventive concept are compared.

FIG. 4 is a diagram schematically illustrating different stress levels for a LED module, in which applied pressure of a prior art assembly structure are compared, utilizing screws of different dimensions: M3, M4 and M5, and an assembly structure with resilient portions according to the present inventive concept. In the diagram typical pressures in the thermal interface, $P_{th}$, measured in MPa, are illustrated on the y-axis. Typical pressures $P_{screw}$ of a prior art assembly structure using screws of different dimensions are measured within the range of 100-1000 MPa when applying a screw torque $\tau$ (x-axis) on the screw mounting selected within a standard used screw torque range, for M3 screw: 1.17 Nm, M4 screw: 2.74 Nm, and M5 screw: 5.49 Nm.

Furthermore, further max stress levels $P_{max_plastics}$ of different plastics materials are indicated on the y-axis which are typically used in the LED module housings. As is illustrated in the diagram, the stress levels $P_{screw}$ caused by standard used screw torques, by far exceed the max stress levels $P_{max_plastics}$, of about 10 MPa, of different plastic. Further, as illustrated the typical operating window for various thermal interface materials, $P_{th_materials}$, is at an even lower range then the max stress levels for the plastics, about 0.01-1 MPa. Further, a typical pressure range defined by utilizing a fixation device according to the present inventive concept to fixate the LED module is illustrated and indicated in the diagram as $P_{clips}$. As can be deducted from the diagram, the pressure range, defined for a typical fixation device, is within the operating range of the typical thermal interface materials, which means that the thermal movement of the materials are more or less allowed. This dramatically decreases the stress induced in the LED modules due to thermal changes in the materials. Preferably, the spring constant of the resilient portion is tuned to match the used thermal interface material.

Figure 5:
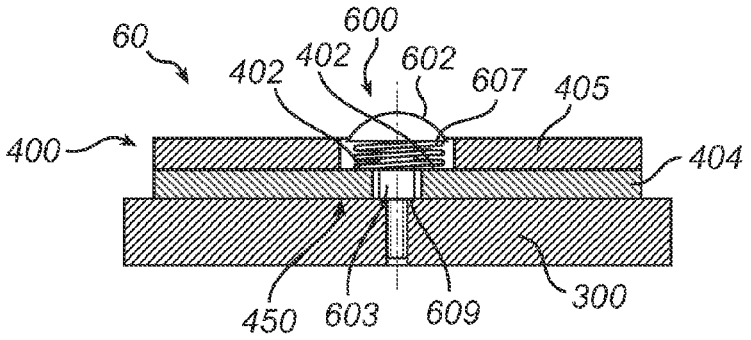
FIG. 5 is a schematic cross sectional view of an embodiment of an assembly structure according to the present inventive concept.

According to an embodiment of the inventive concept, an assembly structure 60 is described with reference to FIG. 5, which is a cross-sectional close up view of a section of the assembly structure 60 when mounted on a mounting surface 300. The assembly structure 60 comprises a LED module 400 with a main structure as previously described, and a fixation device 600 according to the present inventive concept for fixating the LED module to the mounting surface 300. The fixation device 600 comprises, in this example, a cylinder shaped main body 603, which comprises a flat bottom portion 609 arranged for engaging with the mounting surface 300. The shape of the main body is not restricted to a cylinder shape, but may be selected to have any applicable shape. The main body 603 may be provided with an opening for receiving a screw 602 which acts as the first fixation means for fixating the LED module 400 against the mounting surface 300, or alternatively the main body is integrated with a screw or similar fastening means, e.g. a rivet. A resilient portion 607, in the form of a wire spring, with an outer diameter being larger than an opening 409 for receiving the fixation device of the LED module, is arranged to encompass the main body 603. The resilient portion 607 may be attached to an upper part of the main body, or arranged such that it is kept in place by means of the first fixation means, i.e. here the screw head. Thereby, when arranging the fixation device 600 in the opening 409 and tightening the first fixation means, in this example screw 602, the bottom surface of the resilient portion 607 bears against a bearing surface 402 of the LED module. Thereby a pressing force applied on the LED module 400, and consequently on the interface 450 between the LED module 400 and the mounting surface 300, is defined by a dedicated spring force of the spring portion 607, while the screw torque applied on the first fixation means 602 has no influence on this pressing force. In FIG. 5, the opening 409 of the LED module is arranged such that the bearing surface 402 is arranged on the base plate 404. In an alternative embodiment the opening or the dimension of the wire spring is selected such that the bearing surface is arranged on the housing/lens plate 405.

The invention has mainly been described above with reference to a few embodiments. However, as is readily appreciated by a person skilled in the art, other embodiments than the ones disclosed above are equally possible within the scope of the invention, as defined by the appended claims.

The invention claimed is:

1. An assembly structure comprising:

a housing arranged on top of a base plate of a light emitting diode (LED) module and at least one fixation device distributed over the LED module, being positioned in a respective opening of the LED module extending through both the housing and the base plate, the at least one fixation device comprising:

a main body;

a first fixation means for fixating a bottom portion of the fixation device to the mounting surface;

a second fixation means to fixate the fixation device to the housing; and a vertical portion extending from the main body in a substantial perpendicular direction and from which vertical portion at least one resilient portion extends which in a mounted position at least partly bears against protruding portions arranged on the upper surface of the housing such that a pressing force is applied the LED module by means of the resilient portions such that the LED module is secured against the mounting surface.

2. An assembly structure according to claim 1, wherein the first fixation means is symmetrically arranged on the main body.

3. An assembly structure according to claim 1, wherein the housing is a lens plate.

4. An assembly structure according to claim 1, wherein the housing is mounted to the base plate by means of positioning pins with friction ribs which are received in corresponding openings in the base plate.

5. An assembly structure according to claim 1, wherein the second fixation means is a snap connection.

6. An assembly structure according to claim 5, wherein the second fixation means are two snap connections arranged on each fixation device and which are adapted to be received in corresponding openings in the housing.

7. An assembly structure according to claim 1, wherein the fixation device is a metal sheet clip.

8. An assembly structure according to claim 1, wherein the first fixation means comprises an opening and a screw.

* * * * *